US007158643B2

(12) United States Patent
Lavoie et al.

(10) Patent No.: US 7,158,643 B2
(45) Date of Patent: Jan. 2, 2007

(54) AUTO-CALIBRATING SURROUND SYSTEM

(75) Inventors: Bruce S. Lavoie, Shrewsbury, MA (US); William R. Michalson, Charlton, MA (US)

(73) Assignee: Keyhold Engineering, Inc., Northborough, MA (US)

( * ) Notice: Subject to any disclaimer, the term of this patent is extended or adjusted under 35 U.S.C. 154(b) by 639 days.

(21) Appl. No.: 09/839,485

(22) Filed: Apr. 20, 2001

(65) Prior Publication Data

US 2001/0038702 A1 Nov. 8, 2001

Related U.S. Application Data

(60) Provisional application No. 60/198,927, filed on Apr. 21, 2000.

(51) Int. Cl.
*H04R 29/00* (2006.01)

(52) U.S. Cl. ..... 381/58; 381/303; 381/59

(58) Field of Classification Search ..... 381/303, 381/307, 58, 103, 96, 98, 101, 102
See application file for complete search history.

(56) References Cited

U.S. PATENT DOCUMENTS 4,628,530 A * 12/1986 Op De Beek et al. ..... 381/103
5,481,615 A * 1/1996 Eatwell et al. ..... 381/71.6
5,666,424 A * 9/1997 Fosgate et al. ..... 381/18
5,742,694 A * 4/1998 Eatwell ..... 381/94.2
6,639,989 B1 * 10/2003 Zacharov et al. ..... 381/303
6,718,041 B1 * 4/2004 Debail ..... 381/66

FOREIGN PATENT DOCUMENTS

JP 10136498 5/1998
WO WO 97/40642 10/1997

* cited by examiner

*Primary Examiner*—Xu Mei
(74) *Attorney, Agent, or Firm*—Fish & Neave IP Group Ropes & Gray LLP

(57) ABSTRACT

A multi-channel surround sound system and method is described that allows automatic and independent calibration and adjustment of the frequency, amplitude and time response of each channel of the surround sound system. The disclosed auto-calibrating surround sound (ACSS) system includes a processor that generates a test signal represented by a temporal maximum length sequence (MLS) and supplies the test signal as part of an electric input signal to a loudspeaker. A microphone coupled to the processor receives the signal in a listening environment. The processor correlates the received sound signal with the test signal in the time domain and determines from the correlated signals a whitened response of the audio channel in the listening environment.

17 Claims, 15 Drawing Sheets

AUTO-CALIBRATING SURROUND SYSTEM

CROSS-REFERENCE TO OTHER PATENT APPLICATIONS

This application claims the benefit of U.S. provisional Patent Application No. 60/198,927, filed Apr. 21, 2000, which is incorporated herein by reference in its entirety.

FIELD OF THE INVENTION

The invention is directed to a multi-channel surround sound system, and more particularly to a surround sound system allowing automatic calibration and adjustment of the frequency, amplitude and time response of each channel.

BACKGROUND INVENTION

"Surround sound" is a term used in audio engineering to refer to sound reproduction systems that use multiple channels and speakers to provide a listener positioned between the speakers with a simulated placement of sound sources. Sound can be reproduced with a different delay and at different intensities through one or more of the speakers to "surround" the listener with sound sources and thereby create a more interesting or realistic listening experience.

Multi-channel surround sound is employed in movie theater and home theater applications. In one common configuration, the listener in a home theater is surrounded by five speakers instead of the two speakers used in traditional home stereo system. Of the five speakers, three are placed in the front of the room, with the remaining two surround speakers located to the rear or sides (THX dipolar) of the listening/viewing position. Among the various surround sound formats in use today, Dolby® Surround™ is the original surround format, developed in the early 1970's for movie theaters. Dolby® Digital™ made its debut in 1996 and is installed in more than 30,000 movie theaters and 31 million home-theater products. Dolby Digital is a digital format with six discrete audio channels and overcomes certain limitations of Dolby Surround which relies on a matrix system that combines four audio channels into two channels to be stored on the recording media. Dolby Digital is also called a 5.1 -channel format and was universally adopted several years ago for film-sound recording. Yet another new format is called Digital Theater System (DTS). DTS offers higher audio quality than Dolby Digital (1,411,200 versus 384,000 bits per second) as well as an optional 7.1 configuration.

The audio/video preamplifier (or A/V controller) handles the job of decoding the two-channel Dolby Surround, Dolby Digital, or DTS encoded signal into the respective separate channels. The A/V preamplifier output provides six line level signals for the left, center, right, left surround, right surround, and subwoofer channels, respectively. These separate outputs are fed to a multiple-channel power amplifier or as is the case with an integrated receiver, are internally amplified, to drive the home-theater loudspeaker system.

Manually setting up and fine-tuning the A/V preamplifier for best performance can be demanding. After connecting a home-theater system according to the owners' manuals, the preamplifier or receiver for the loudspeaker setup have to be configured. For example, the A/V receiver or preamplifier must know the loudspeaker type, so that the bass can be directed appropriately. For example, receivers may classify loudspeakers as "large" or "small". Selecting a "small" loudspeaker will keep low-bass signals out of the speaker. This configuration is used when a subwoofer is used to reproduce low bass instead of the left and right speakers. If the system has no subwoofer and full-range left and right speakers, a "large" speaker setting should be selected. The setup may also require selecting "small" or "large" surround speakers. Next a center channel speaker mode ("normal" or "wide") needs to be selected, as well as an appropriate center-channel delay so that the sound from all three front speakers arrives at a listener's ear at the same time. An additional short delay for the signal to the surround speakers of typically 20 ms may also have to be set to improve the apparent separation between front and rear sound.

In addition, the loudness of each of the audio channels (the actual number of channels being determined by the specific surround sound format in use) should be individually set to provide an overall balance in the volume from the loudspeakers. This process begins by producing a "test signal" in the form of noise sequentially from each speaker and adjusting the volume of each speaker independently at the listening/viewing position. The recommended tool for this task is the Sound Pressure Level (SPL) meter. This provides compensation for different loudspeaker sensitivities, listening-room acoustics, and loudspeaker placements. Other factors, such as an asymmetric listening space and/or angled viewing area, windows, archways and sloped ceilings, can make calibration much more complicated It would therefore be desirable to provide a system and process that automatically calibrates a multiple channel sound system by adjusting the frequency response, amplitude response and time response of each audio channel. It is moreover desirable that the process can be performed during the normal operation of the surround sound system without disturbing the listener.

SUMMARY OF THE INVENTION

The invention is directed to a surround sound system with an automatic calibration feature for adjusting audio channel responses to the characteristic of the listening environment. The invention is also directed to a method that provides calibration and adjustment of the frequency, amplitude and time response of each channel of the surround sound system in a manner that is unobtrusive to a listener and can be employed during the listening experience of the listener.

According to one aspect of the invention, an auto-calibrating surround sound (ACSS) system includes an electro-acoustic converter, such as a loudspeaker, disposed in an audio channel and adapted to emit a sound signal in response to an electric input signal. The ACSS system further includes a processor that generates a test signal represented by a temporal maximum length sequence (MLS) and supplies the test signal as part of the electric input signal to the electro-acoustic converter, and an acousto-electric converter, such as a microphone, that receives the sound signal in a listening environment and supplies a received electric signal to the processor. The processor correlates the received electric signal with the test signal in the time domain and determines from the correlated signals a whitened response of the audio channel in the listening environment.

The processor may include an impulse modeler that produces a error fit, for example, a polynomial least-mean-square (LMS) fit, between a desired whitened response and the whitened response determined from the correlated signals, as well as a coefficient extractor which generates from the correlated signals filter coefficients of a corrective filter to produce the whitened response of the audio channel. The corrective filter may be located in an audio signal path between an audio signal line input and the electro-acoustic converter and cascaded with the audio signal line input. The correlator and/or the IM and/or the corrective filter may be part of the processor. The processor can be a digital signal processor (DSP), and the ACSS system can further include A/D and D/A converters to enable digital processing of analog signals in the DSP.

According to another aspect of the invention, a digital filter for whitening an audio channel in a listening environment includes an input receiving a digital audio signal, and a corrective filter having filter coefficients that are determined in the listening environment using a maximum length sequence (MLS) test signal. The corrective filter convolves the filter coefficients with the digital audio signal to form a corrected audio signal. An output supplies the corrected audio signal to a sound generator.

According to yet another aspect of the invention, a method of auto-calibrating a surround sound system includes the acts of producing an electric calibration signal which is a maximum length sequence (MLS) signal; supplying the calibration signal to an electro-acoustic converter which converts the calibration signal to an acoustic response; and transmitting the acoustic response as a sound wave in a listening environment to an acousto-electric converter. The acousto-electric converter converts the acoustic response into an electric response signal. The method further includes correlating the electric response signal with the electric calibration signal to compute filter coefficients, and cascading the filter coefficients with a predetermined channel response of the electro-acoustic converter to produce a whitened system response.

According to still another aspect of the invention, method of producing a matched filter for whitening an audio channel in a listening environment includes producing in the audio channel a test output sound corresponding to a temporal maximum length sequence (MLS) signal; receiving the test output sound at a predetermined location in the listening environment, thereby producing an impulse response; analyzing a correlation between the impulse response and the MLS signal; and generating from the analyzed correlation filter coefficients of the matched filter.

Embodiments of the invention may include one or more of the following features. The calibration signal has a noise characteristic that is non-offensive to a listener located in the listening environment and a duration of less than approximately 3 seconds. The surround sound system may include a plurality of audio channels, with each channel having at least one electro-acoustic converter, wherein the whitened response is produced independently for each audio channel. The filter coefficients may be generated by optimizing a "closeness of fit", for example, a least sum of squares error value, between the polynomial model and the matched filter. Optimization of the "closeness of fit" may include adjusting the length of the MLS signal. To produce the whitened audio channel, the matched filter can be cascaded with a useful audio signal.

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

DETAILED DESCRIPTION OF CERTAIN ILLUSTRATED EMBODIMENTS

The invention is directed to an auto-calibrating surround sound system that automatically adjusts the frequency response, amplitude response and time response of each audio channel without intervention from the listener. In particular, the system and method described herein can be used to whiten the frequency response of the sound system even in changing listening environments. A signal is defined as "white" if the signal exhibits equal energy per Hz bandwidth. Accordingly, a white or whitened response of an audio system is defined as a sound output signal produced by an electro-acoustic converter, such as a loudspeaker, that exhibits equal output energy per Hz bandwidth for an electric input signal to the system with equal electric energy per Hz bandwidth.

Figure 1:
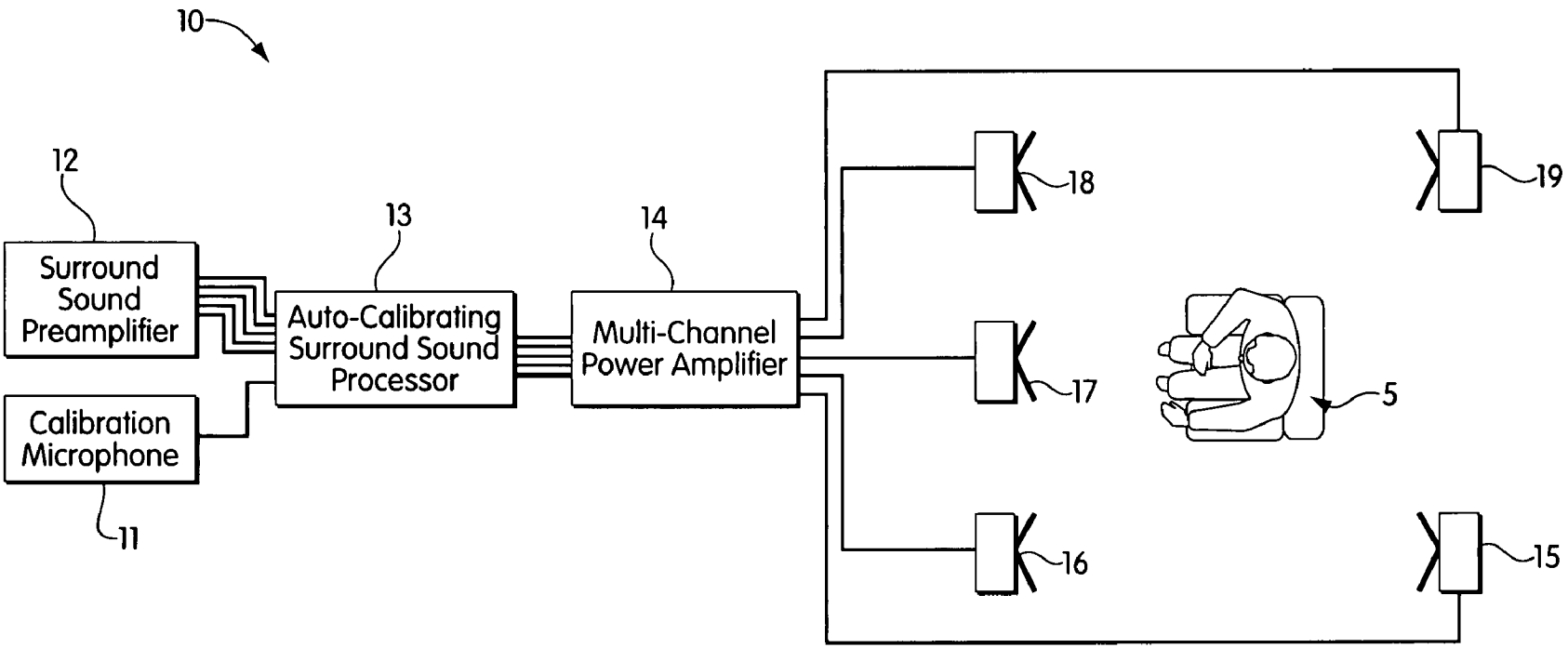
FIG. 1 shows a schematic block diagram of an ACSS System.

Referring first to FIG. 1, an auto-calibrating surround sound (ACSS) system 10 includes a surround sound preamplifier 12 receiving audio input signal from various conventional audio devices (not shown), such as tuners, CD and DVD players, and other digital or analog signal sources, a multi-channel power amplifier 14 inserted in the signal path between the preamplifier 12 and a plurality of loudspeakers 15, 16, 17, 18, 19 located in the listening environment. The location of the loudspeakers is selected so that a listener has the impression of being surrounded by sound by, for example, placing loudspeakers 15 and 19 to the left and right behind the listener and loudspeakers 16 and 18 to the left and right in front of the listener. Loudspeaker 17 is typically located at the center to covey, for example, dialog from actors shown on a TV screen. The components 12, 14 and the loudspeakers 15, . . . , 19 are part of a conventional surround sound system.

As part of the auto-calibration feature, an auto-calibrating surround sound processor 13 is typically connected between the line level outputs of the preamplifier 12 and the line level inputs of the multi-channel power amplifier 14. The auto-calibrating surround sound processor 13 has an additional input for a calibration microphone 11 as well as a user control (or menu item) for initiating a calibration sequence (not shown). Once the system 10 is calibrated, the calibration microphone 11 is no longer needed and may be disconnected until the user decides to recalibrate the system.

Figure 2:
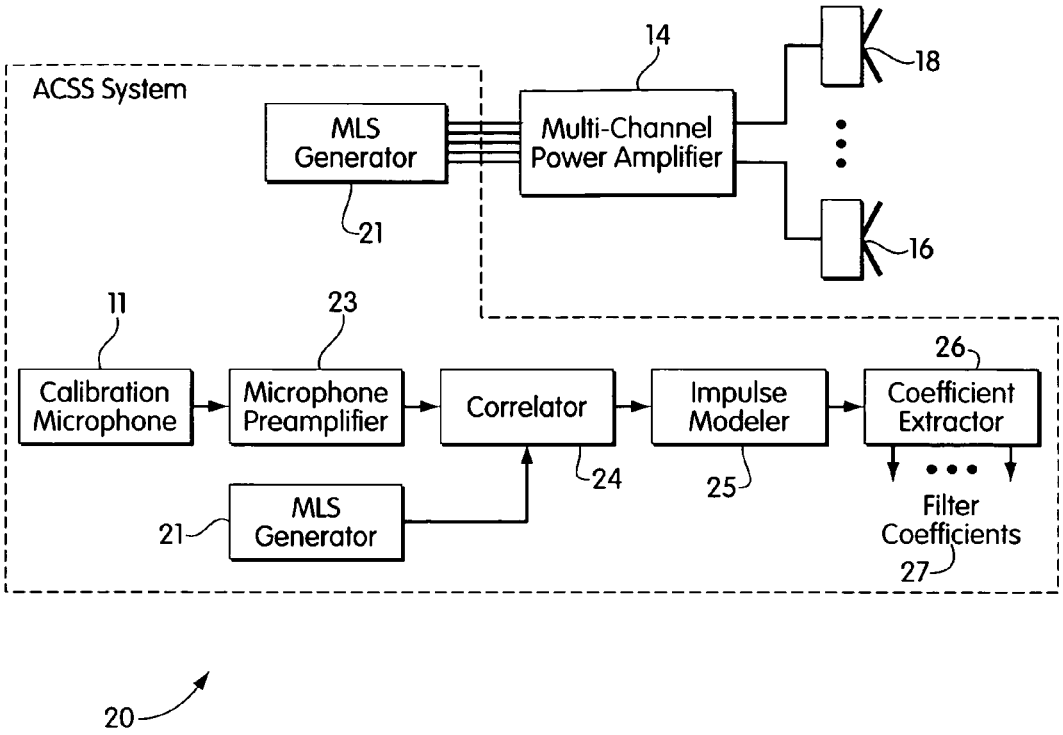
FIG. 2 shows schematically a calibration process for the ACSS.
Figure 3:
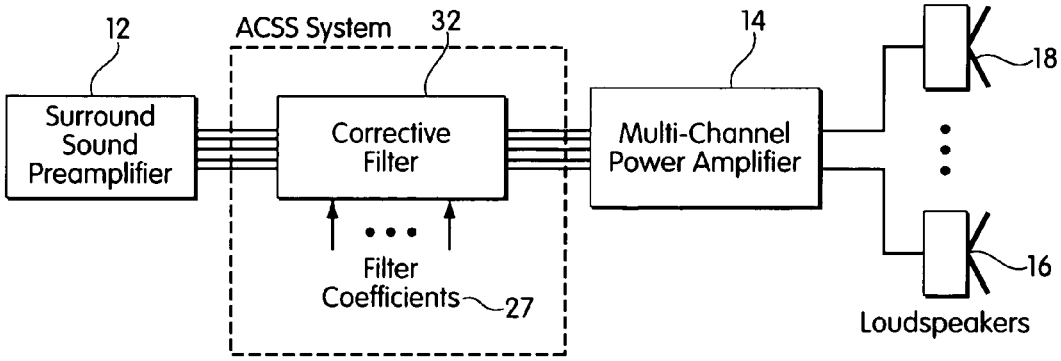
FIG. 3 shows the ACSS system in its operational phase.

Referring now to FIGS. 2 and 3, two operating phases of the ACSS should be distinguished: the calibration phase (FIG. 2) and the operational phase (FIG. 3). During the calibration phase depicted in FIG. 2, the ACSS system 20 generates a calibration signal which can be a separate signal for each loudspeaker 15, . . . , in the system (the actual number of loudspeakers being determined by the desired number of channels). Typically, the center loudspeaker 17 need not be calibrated. The calibration signal is a non-offensive noise, similar to white noise, which is only audible for a small amount of time (a total duration of 2–3 seconds or less). The calibration microphone 11 placed at the listener location collects the response from the loudspeakers 15, . . . , 19.

The calibration noise signal in the described embodiment is pseudo-random in nature and derived from a maximal length sequence (MLS) generated by MLS generator 21. The signal generated by MLS generator 21 is supplied to the power amplifier 14 to drive the loudspeakers 15, . . . , 19. The MLS is deterministic so that the samples received from the microphone 11 and optionally amplified in microphone preamplifier 23 can be correlated in correlator 24 with an exact replica of the MLS signal used to drive the loudspeakers, as indicated by a connection between correlator 24 and MLS generator 21. The output of correlator 24 is supplied to impulse modeler 25 to derive the impulse response for a channel in the surround sound system 10. From this impulse response, the time of flight between the listener and each loudspeaker and the frequency response of the channel is determined. The power spectrum of the received signal is a function of the frequency response of the power amplifier, the loudspeakers, room acoustics, and the calibration microphone. In most cases, the dominant factors in determining the frequency response is the frequency response of the loudspeakers and the room acoustics. If any of these elements are changed or repositioned, then the power spectrum and times of flight may change.

The measured impulse response derived from the correlator 24 is typically not well-behaved in a mathematical sense because it is not a continuous function and therefore may contain discontinuities. Some of the difficulties associated with these discontinuities can be eliminated by forming a model of the measured impulse response. This is done in the impulse modeler 25, which creates a recursive estimator of the impulse response, using, for example, an auto-regressive (AR) curve fitting technique with a polynomial model to create a least-mean-square (LMS) error curve fit to the measured impulse response. This model of the impulse response is then used by coefficient extractor 26 to generate the coefficients 27 for a matched filter to correct the channel response.

FIG. 3 illustrates the operational phase of the ACSS system 30. Once the required filter coefficients 27 are determined, a real-time corrective filter 32 is initialized with the proper correction coefficients in the time domain for each channel in the surround sound system. In this system, each set of coefficients defines a filter that is unique to the requirements of the respective channel. The corrective filter 32 is placed in the audio signal path between the surround sound preamplifier 12 and the multi-channel power amplifier 14 to whiten the system response, as will be described in detail below. It should be noted that the corrective filter 32 can be part of the ACSS processor 13 of FIG. 1. It is also possible to switch the corrective filter 32 in and out of the signal path as needed. In addition, it should be noted that the audio signal could be either an analog, a digital signal or some combination of analog and/or digital signals.

Figure 4:
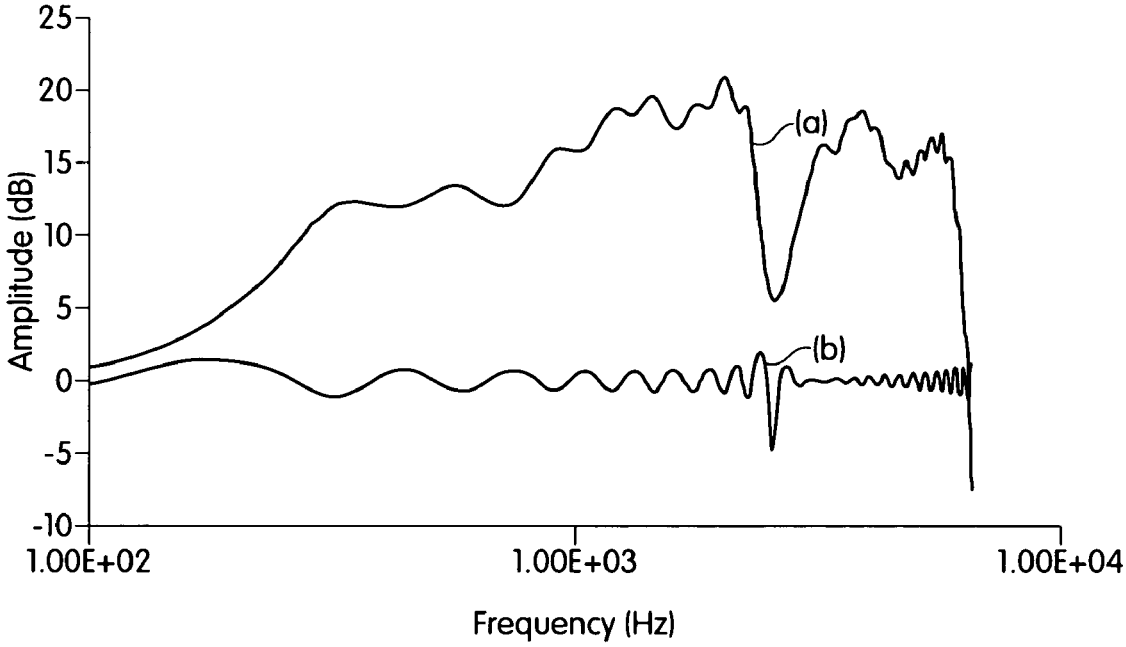
FIGS. 4*a–b* show an uncorrected (a) and a whitened (b) frequency response of an exemplary ACSS System.

FIG. 4 shows the result obtained by applying the ACSS process to an exemplary low-cost surround sound system of a type designed for personal computer systems. The top graph (a) shows the uncorrected amplitude response of the system in the frequency domain. The frequency range is limited to an upper frequency of approximately 6.5 kHz due to the limited sampling rate of the A/D converter used to sample the original impulse response. The lower limit of the frequency range starts at 100 Hz since the speaker is used as a satellite speaker and hence performs poorly in reproducing low frequencies.

As seen in FIG. 4(*a*), this particular loudspeaker has wide amplitude excursions in excess of 20 dB over the entire illustrated frequency range. Further, speaker has a noticeable 15 dB null at approximately 2.5 kHz. The bottom curve (b) shows the frequency response of the system after ACSS correction. The majority of the previously uncorrected amplitude excursions are now well controlled to within approximately ±2 dB of the nominal response. Moreover, the effect of the deep null in the original response, although still noticeable, is significantly reduced.

The operation of the ACSS system will now be described in detail. As known from mathematical concepts, a frequency response of a system (the changes in magnitude and delay that the system imparts to sine waves of different frequencies applied to its input) has a one-to-one relationship to an impulse response (the waveform with which a system responds to a sharp impulse applied to its input). The two responses can be converted into each other by a Fourier Transform and inverse Fourier Transform, respectively.

Consequently, a system, such as a loudspeaker, can be characterized either by applying sine waves to find the frequency response, or by applying impulse stimuli to obtain the impulse response. Once either type of data is obtained, transformation from one to the other is a simple matter of processing the Fourier transforms (typically using a computer). A narrow pulse is attractive as a measurement stimulus for several reasons. It is easy to generate using inexpensive circuitry. Both the phase and magnitude of the frequency spectrum of a narrow pulse are essentially uniform over a wide range of frequencies, allowing simultaneous measurements over most or all of the amplitude and frequency ranges of a speaker and/or amplifier. Echoes in a system pulse response are easily identified and removed, so that measurements equivalent to those from an anechoic chamber can be obtained.

Since the energy of a single pulse may be small and cannot be easily increased without "clipping" in the amplifier circuitry and/or driving the loudspeaker into nonlinear operation, a number of measures can be taken to increase the average power of the test signal. For example, repetitive pulse stimuli can be applied; however, to increase the noise rejection by 30 dB, over one thousand responses may be required, resulting in an unacceptably long calibration time. Alternatively, a frequency sweep or "chirp", or so-called "pink" noise, which has an even distribution of power if the frequency is mapped in a logarithmic scale, can be employed. A full response measurement also takes a rather long time, as each frequency is essentially measured separately.

A very convenient stimulus is pseudo-random noise, which is the frequency-domain version of a digital signal in the time domain known as a Pseudo-random Number (PN) pattern or Maximum Length Sequence (MLS). The magnitude of a pseudo-random noise spectrum in the frequency domain is basically flat, while the phase is scrambled—but not really random. Since the spectrum is deterministic and repeatable, only a single measurement channel is required for characterizing the system.

The MLS additionally has the property that its autocorrelation function represents an impulse signal, whereas the cross-correlation function between the response of a system to an MLS with the MLS itself is the impulse response of the system which can be transformed to provide the frequency response of the system, or analyzed in the time domain.

Figure 5:
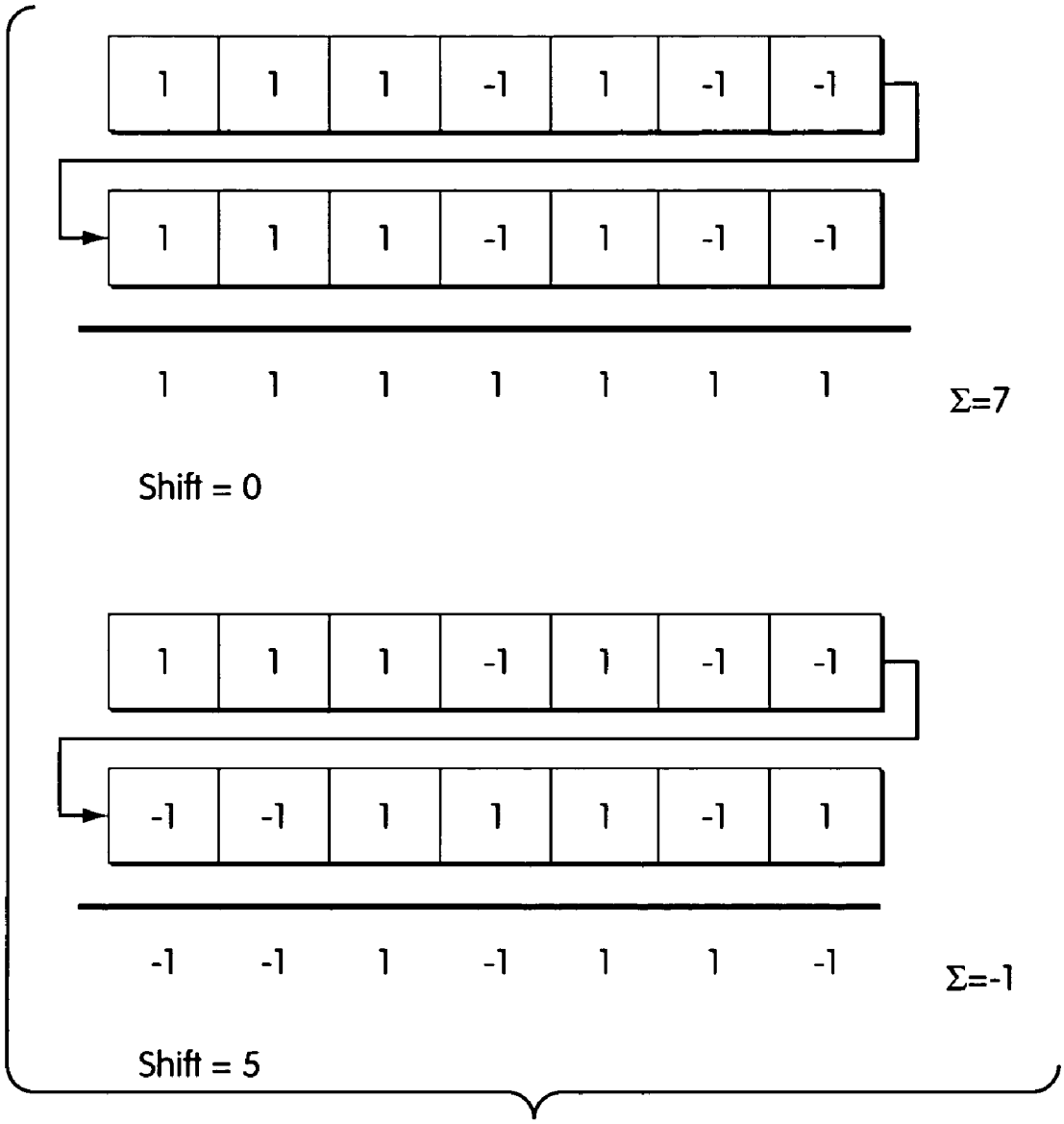
FIG. 5 shows an exemplary minimum length sequence (MLS)

FIG. 5 illustrates an exemplary MLS of length 7, modified so that a digital "0" is represented as "−1". If a copy of the sequence is lined up exactly underneath the original sequence (autocorrelation), as indicated in the upper portion of FIG. 5, and the corresponding values are multiplied and all the products are summed, a value 7 equal to the length of the MLS is obtained. If the second sequence is shifted from the original sequence by, for example, 5 time intervals or clock cycles, as indicated in the lower portion of FIG. 5, which is equivalent to a time shift of an MLS signal, then the sum of the products in this example yields a value of −1. In other words, the correlation function between an N-point MLS has a sharp peak when the MLS line up exactly, with the signal being negligibly small if an MLS response signal is misregistered with respect to the original MLS signal. This is the underlying concept behind the ACSS system and process.

Referring back to FIG. 2, during the calibration phase, the ACSS generates a calibration signal separately for each loudspeaker in the system. Although the MLS was described above as a sequence of δ-shaped (infinitely short) pulses, in practice an analog MLS may have to be generated from the digital MLS, for example, by using a zero-order-hold (ZOH) with reconstruction filter, so that the letter "S" in MLS then denotes "Signal" rather than "Sequence."

As mentioned above, the system can be modeled either in the time domain or in the frequency domain by applying a DTFT to the impulse response. In the following, the impulse response is modeled in the time domain.

In a linear time-invariant system (LTI), a response depends on a weighted average of the current and past M inputs x[i] well as a weighted average of the most recent N outputs y[k]:

$$y(n) = -\sum_{k=1}^{N} a_k y[n-k] + \sum_{k=0}^{M} b_x x[n-k] \tag{1}$$

This system is sometimes also called to an Auto Regressive Moving Average (ARMA) system. An auto regressive (AR) process of order N can be described in terms of the inner product between a set of coefficients and the previous output values y[n]:

$$y[n]+a_1,y[n-1]+\ldots+a_N y[n-N]=v[n] \tag{2}$$

where $a_n$ are constant coefficients and v[n] is a white noise process used to model an error term. Since the number of coefficients will have practical limits, the impulse response may be truncated, which is equivalent to applying a window function. By recognizing that equation (2) is the convolution of the coefficients $a_n$ and the vector {y[1], . . . , y[n]} of past output samples and recalling that the convolution of two time sequences can be represented as the product of their corresponding Z transforms, one obtains $$Y(z)H_a(z)=V(z) \tag{3}$$

where $H_a(z)$ is the Z transform of the coefficients $a_n$. The equation (3) shows that for some process Y(z) there will be some system function H(z) that will yield the white noise process V(z).

One of the tasks in the present analysis is the determination of the transfer function H(z) for two aspects of the problem, namely to generate the process and to analyze the process. Creating a stable inverse filter is the main motivation for selecting the model to be of type Infinite Impulse Response (IIR). In an IIR-model, the order N of the AR process in equation (2) goes to ∞. The frequency response of a linear time-invariant (LTI) system can be determined entirely in terms of its magnitude and phase $H(e^{j\omega})=|H(\omega)|e^{j\theta(\omega)}$ by evaluating its Z transform on the unit circle, providing that the Fourier transform exists. Complications may arise from the fact that the system is not truly minimum phase, but this error will be small for typical room impulse responses.

Having selected the AR model for the system being measured, an inverse of this model is created so that the effects of the room response can be removed. Because the model is defined to be minimum-phase and stable, it will have an inverse function that is minimum phase as well. Recalling from system theory that the impulse response of cascaded stages is the convolution of the individual impulse responses of the various stages, the output sequence is as follows:

$$y[n]=\{x[n]*h_1[n]\}*h_2[n]=x[n]*\{h_1[n]*h_2[n]\} \tag{4}$$

where x[n] is the input signal and $h_i[n]$ of the impulse responses of an individual stage i.

The next objective is to converge on an optimal set of finite impulse response (FIR) coefficients $b_n$ for the process analyzer that will remove the effects of the room $$y[n] = \sum_{k=0}^{M} b_k x[n-k] \tag{5}$$

Before any coefficients can be estimated, a figure of merit may be defined so that the performance of the model can be analyzed. This figure of merit could be the least sum of squares error between the desired matched filter output and the output of a moving average filter. In this case, if d[n] is the desired response of the matched filter, the following error ϵ[n] results $$\varepsilon[n] = d[n] - \sum_{k=0}^{M} b_k h[n-k] \tag{6}$$

Minimizing a global error term, which is computed from the sum of squared error terms γ, is done by taking the first partial derivative of γ with respect to the coefficients $b_k$ and setting the result to zero, i.e., $\partial\gamma/\partial\gamma_k=0$, to find the minimum point. This leads to a set of linear equations in terms of the cross and autocorrelation as follows $$R_{hd}[l] = \sum_{k=0}^{M} b_k R_{hh}[l-k] \tag{7}$$

Figure 6:
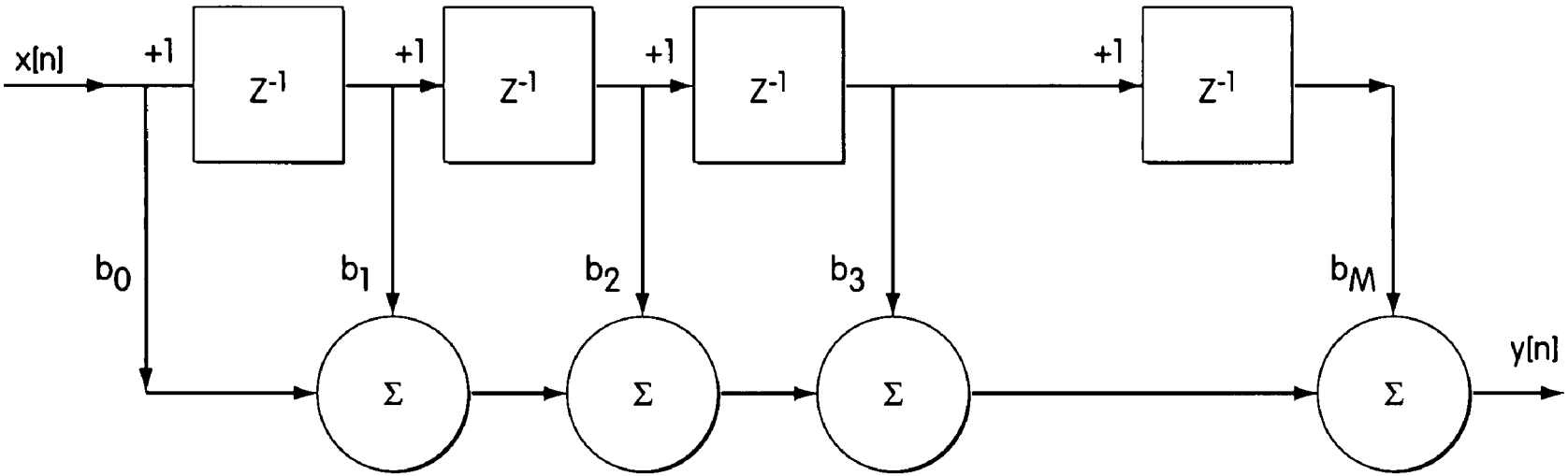
FIG. 6 shows a digital implementation of a matched moving average (FIR) filter.

The moving average filter that uses the coefficients $b_k$ of equation (7) produces minimum error in the least square sense, which is the figure of merit to be optimized. This filter is also known as a Wiener-Filter and is illustrated in FIG. 6. Equation (7) can be seen as the linear convolution between the coefficients $b_n$ and the cross correlation of the matched filter impulse response h[n].

Since the desired power spectral density (PSD) of the combined system under test (SUT) and matched filter should be flat, it can be seen that the cross correlation between d[n] and h[n] will be zero for all values of shift except at the origin, so that equation (7) can be expressed in matrix form as $$\begin{bmatrix} r_{hh}(0) & r_{hh}(1) & r_{hh}(2) & \cdots & r_{hh}(M) \\ r_{hh}(1) & r_{hh}(0) & r_{hh}(1) & \cdots & r_{hh}(M-1) \\ \vdots & \vdots & \vdots & \vdots & \vdots \\ r_{hh}(M) & r_{hh}(M-1) & r_{hh}(M-2) & \cdots & r_{hh}(0) \end{bmatrix} \begin{bmatrix} b_0 \\ b_1 \\ \vdots \\ b_M \end{bmatrix} = \begin{bmatrix} h(0) \\ 0 \\ \vdots \\ 0 \end{bmatrix} \tag{8}$$

As seen from the above, the minimized error term is a function not only of the coefficients $b_n$, but also of the filter length M. The filter length M can be selected by experimental means. However, as part of automating the process, it should also be possible to select the order in an adaptive fashion, without visual inspection.

Figure 7:
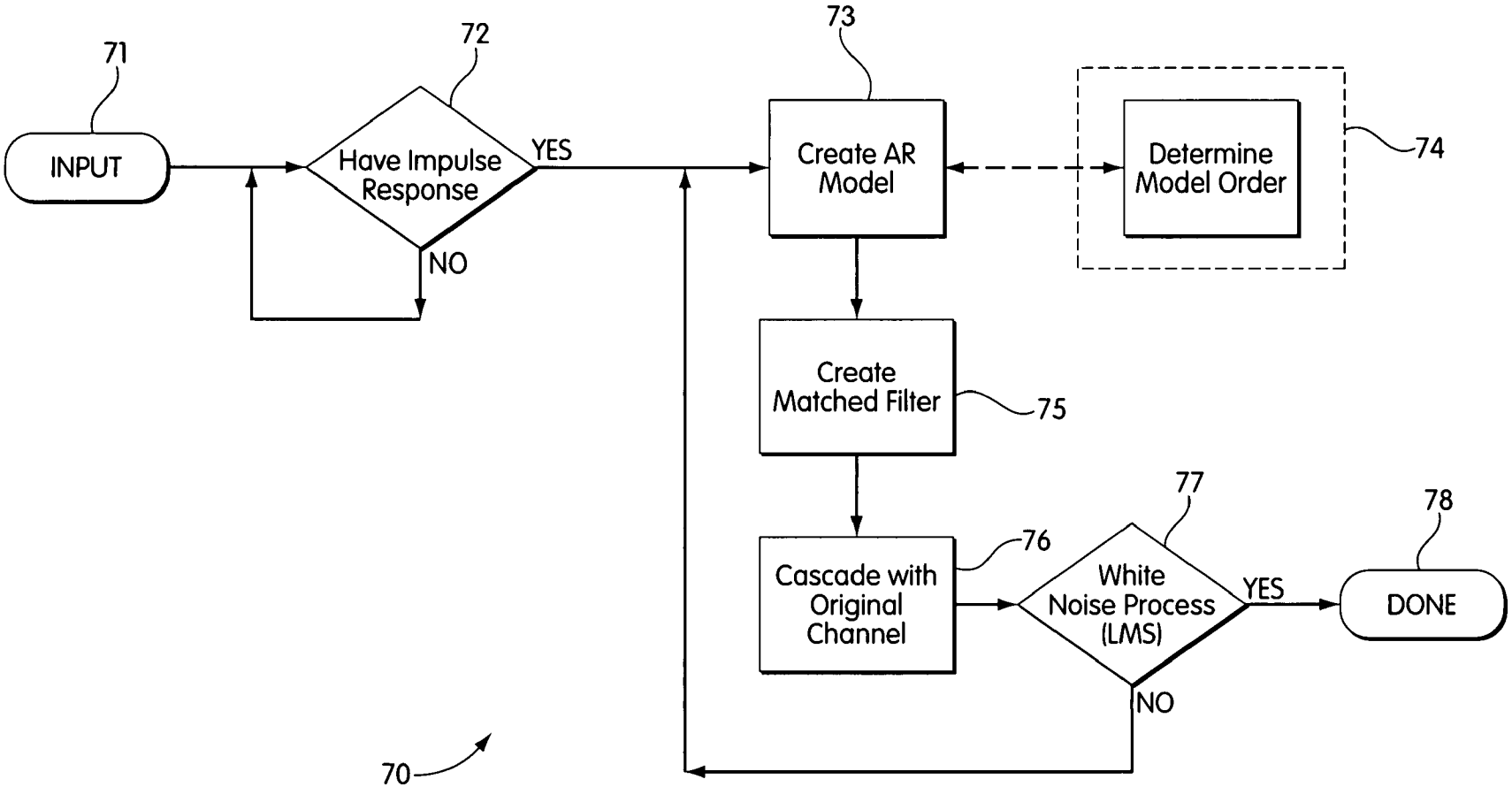
FIG. 7 schematically depicts the process of whitening a channel.

FIG. 7 is a schematic process flow diagram of an auto-calibrating process 70 that produces a whitened system response. The system monitors an input 71, for example, a signal received by calibration microphone 11. If an impulse signal is detected at 72, an auto-regressive (AR) model is created using equations (1)–(3). A matched filter is created by process 75 using equations (5)–(6) and cascaded with the original channel, as described with reference to equations (4) and (7)–(8). If a global minimum error term is attained, step 77, then the system response has been optimally whitened and the auto-calibration, at least for the loudspeaker under test, is terminated in 78. Otherwise, the AR model is revised in 73, possibly using a different model order determined by process step 74.

Figure 8A:
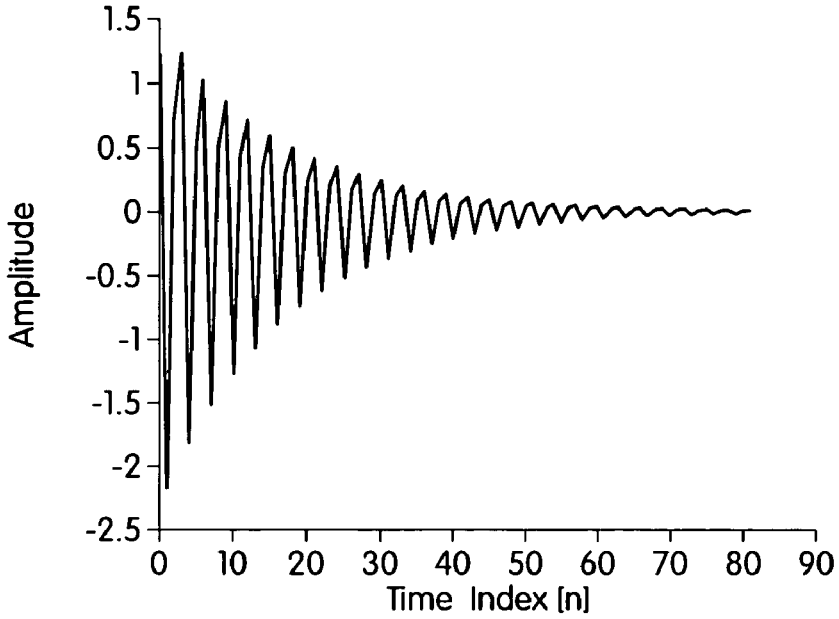
FIGS. 8*a–b* show a simulated channel impulse response (a) and frequency response (b)
Figure 8B:
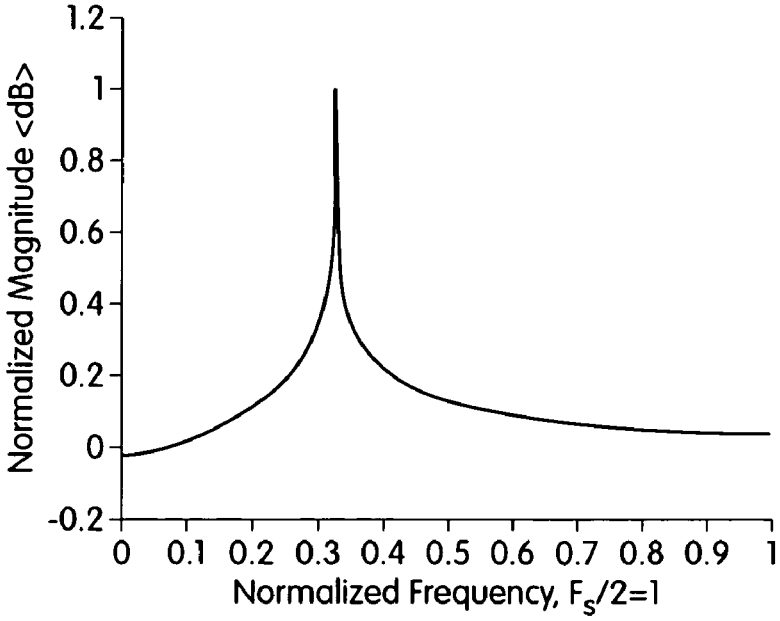
Figure 9A:
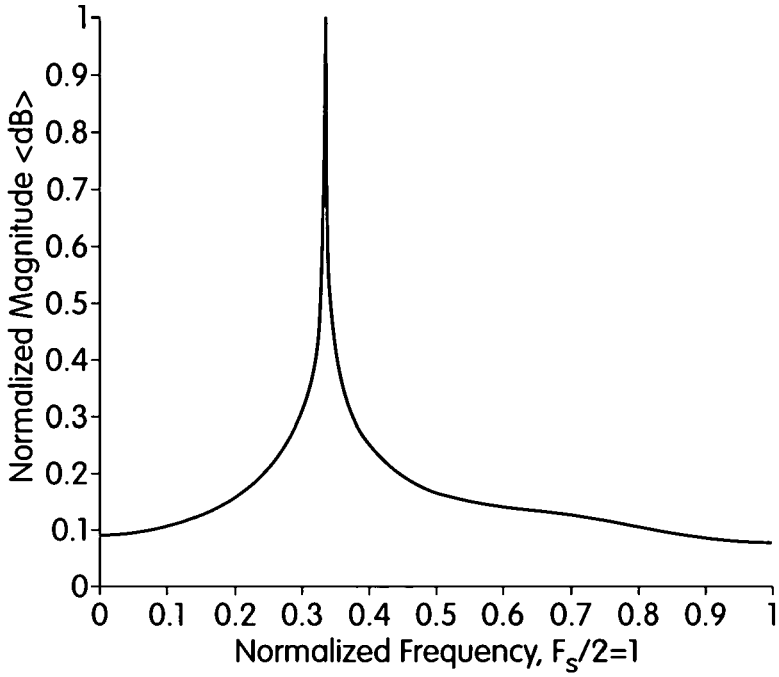
FIGS. 9*a–b* show the frequency response magnitude for the simulated channel impulse response of FIG. 8(*a*): AR model (a) and matched filter (b), both with M=5.
Figure 9B:
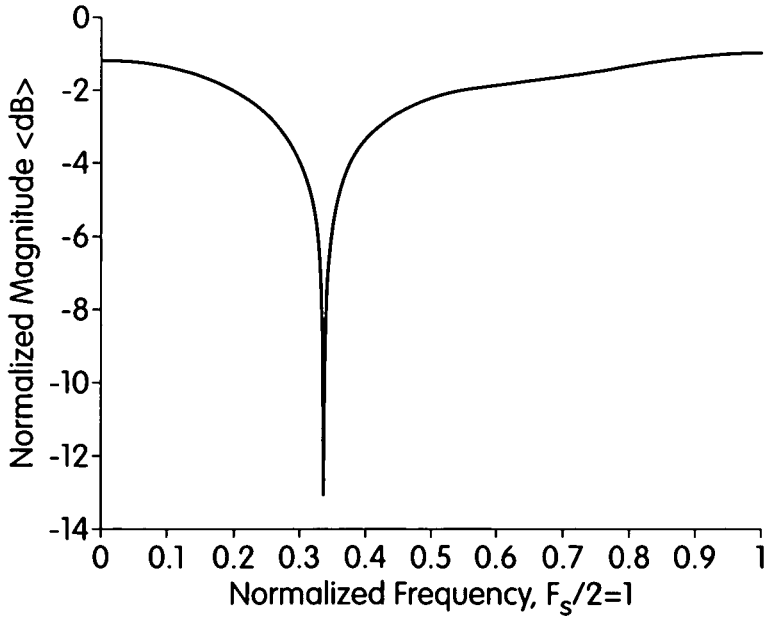
Figure 10A:
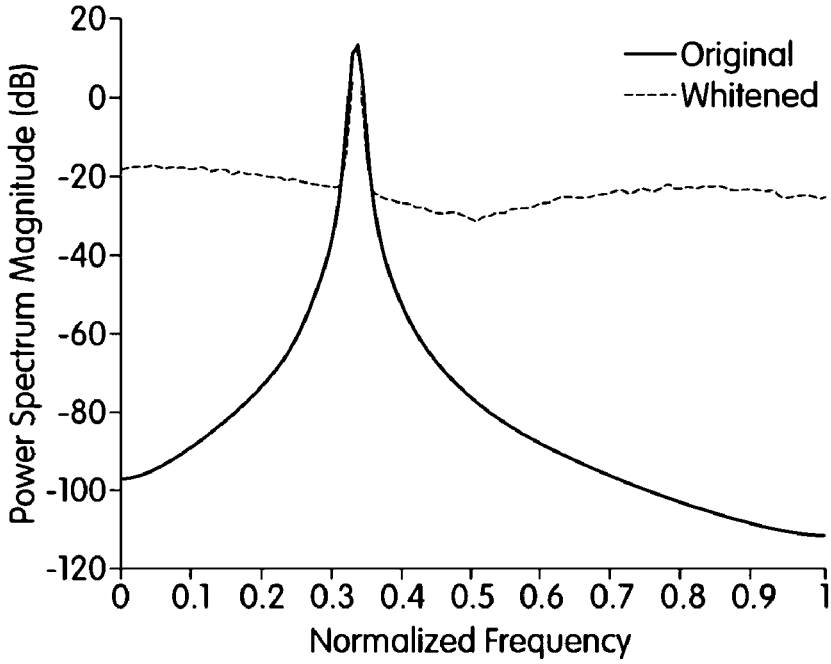
FIGS. 10*a–d* show the whitened power spectral density (PSD) for different values M of the filter order: M=5 (a), M=10 (b), M=20 (c), and M=100 (d)
Figure 10B:
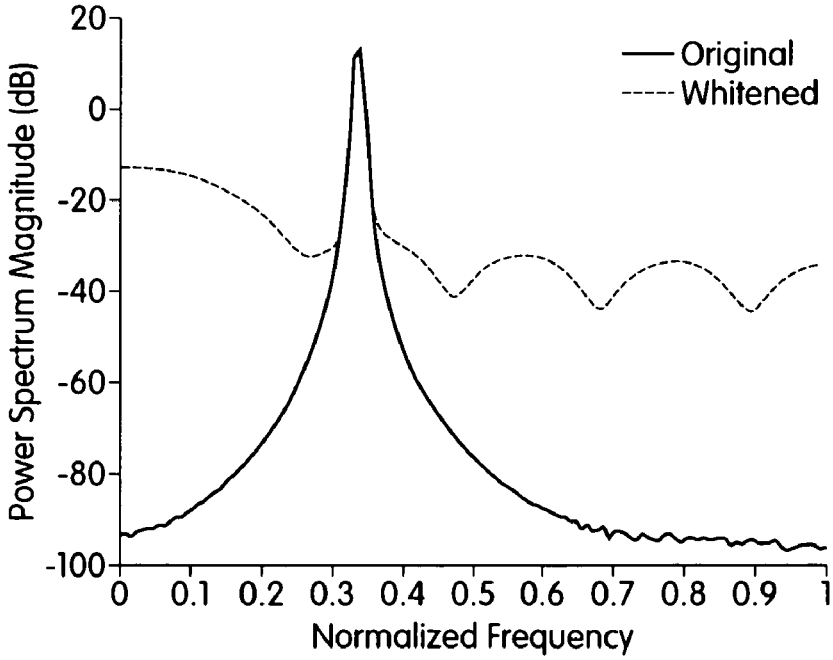
Figure 10C:
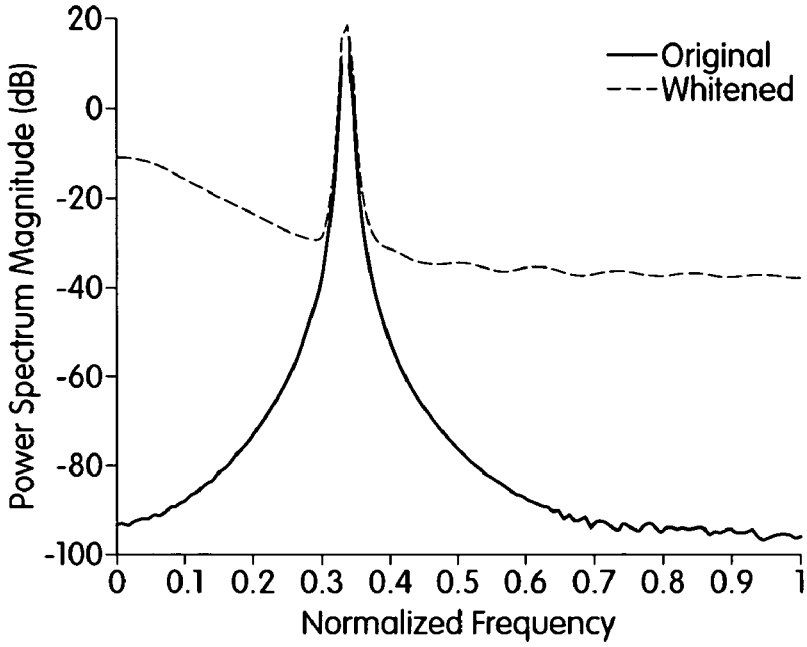
Figure 10D:
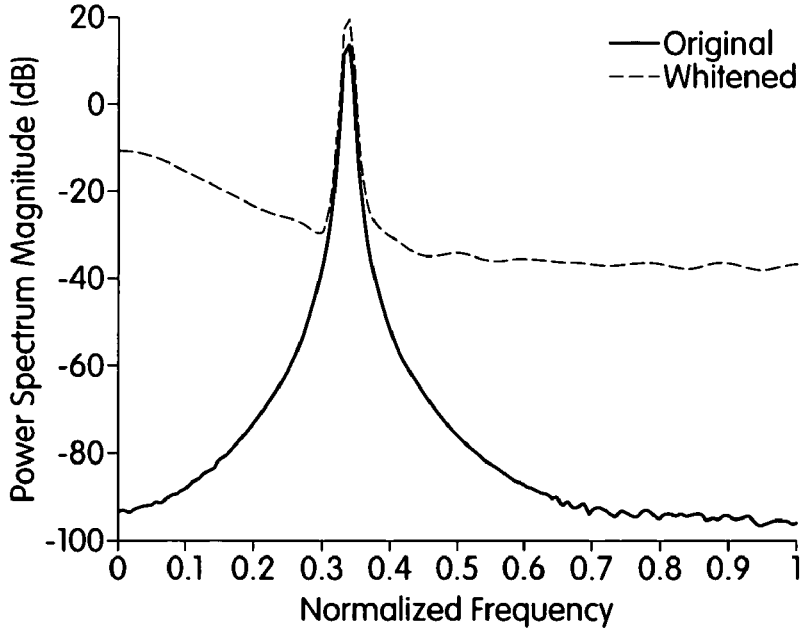

Referring now to FIG. 8*a*, an exemplary simulated channel impulse has the form of an exponentially decaying sinusoidal signal that can be used to the test the deconvolution properties of an MLS. FIG. 8*b* shows the corresponding frequency response, with the spike in the frequency response corresponding to the frequency of the dampened sinusoid. For the simulations, a model order M between M=5 and M=100 was selected. The AR (auto regressive) model parameters, i.e., the filter taps of FIG. 6, are generated as described above with reference to equations (7) and (8). The frequency response magnitude of the AR model with M=5 is shown in FIG. 9(*a*). The corresponding matched filter frequency response is shown in FIG. 9(*b*) and is essentially an "inverted" AR response, i.e., the filter response has poles where the AR response has zeros, and vice versa. A matched filter with a higher order of M, for example M=20, tends to have a sharper frequency response. Finally, the matched filter of FIG. 9(*b*) is cascaded with the original channel to "whiten" the channel, as seen from the process flow of FIG. 7. Filtering the original impulse response using the matched filter should produce an even distribution of spectral power.

FIGS. 10(*a*)–(*d*) show the whitened power spectral density (PSD) for different values M of the filter order between M=5 and M=100. It should be noted that the PSD is not normalized. A filter order of M=10 or M=20 has been found to sufficiently whiten the system response.

It should also be noted that in spite of the matched filter, a peak exclusion of 10 dB or more remain. The inability to reduce the peak magnitude component of this simulation does not indicate failure of the matched filter; rather, it indicates that a lower bound is reached. This is not considered to be a problem since most listening environments require small corrections over a wide range of frequenciesrather than the correction of a single large frequency anomaly.

Figure 11:
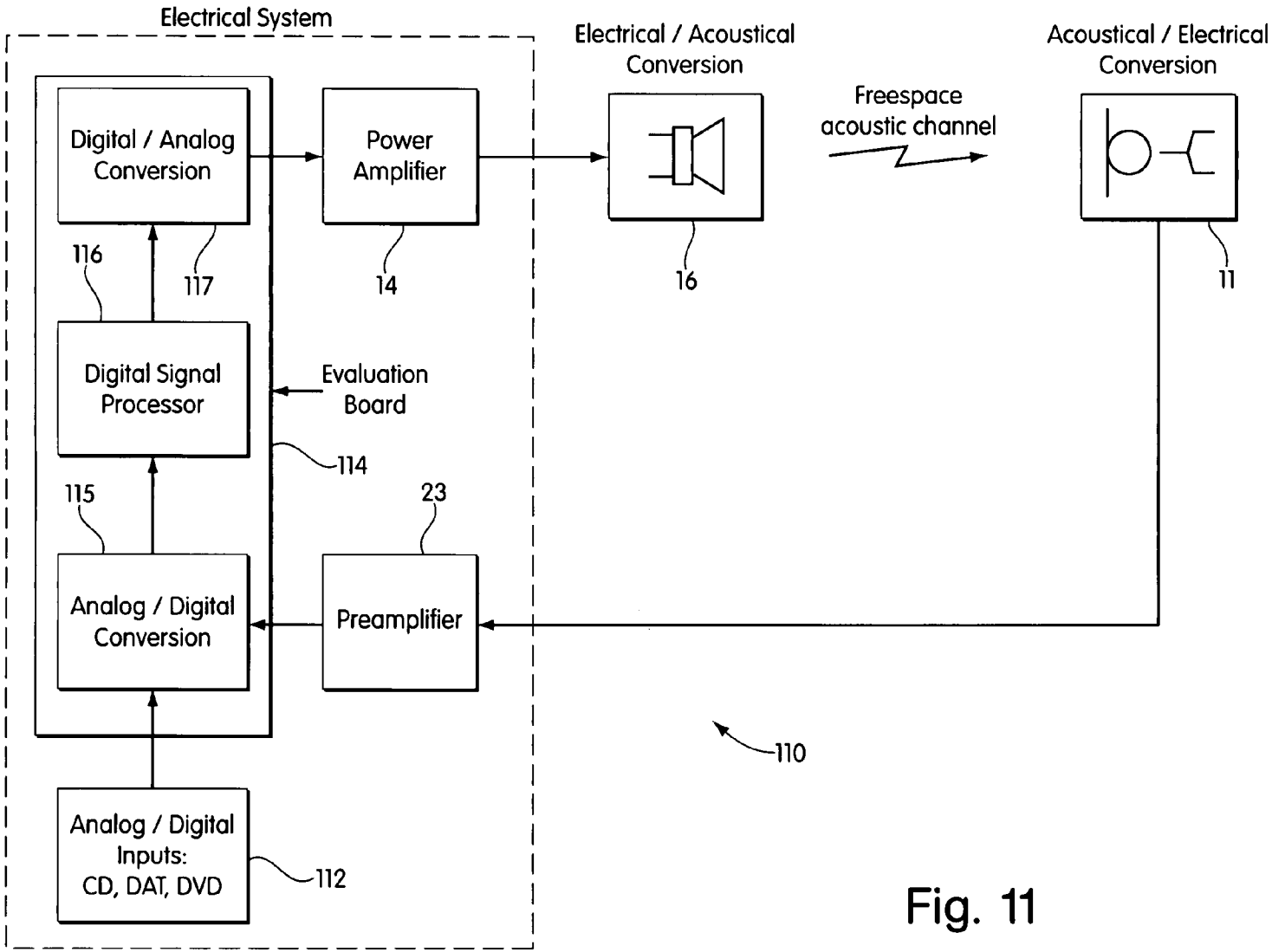
FIG. 11 shows a schematic block diagram of interconnected devices of the ACSS system.

Referring now to FIG. 11, the hardware of the auto calibrating surround sound (ACSS) system can be implemented with standard audio components and digital signal processors. In the exemplary block diagram 110 of the ACSS of FIG. 10, the evaluation board 114 is implemented as an embedded Digital Signal Processor (DSP) 116 with onboard D/A 117 and A/D 115 converters (Texas Instruments TMS320C54XDSKplus board with C542 processor) and a 10 MHz clock. The board 114 receives suitable input signals, either in digital or analog, from input device(s) 112. The other components correspond to those described above with reference to FIG. 2. Although this device has an input/output cutoff frequency significantly below 20 kHz with a 44 kHz sampling rate, it is adequate to demonstrate the validity of the proposed calibration concept. There are many other processors known in the art which can be used. Such processors, when combined with higher resolution D/A and A/D converters and higher sampling rates will result in improved system performance.

As an embedded system device, the first step is to initialize the processor and corresponding peripherals. Before any of the peripherals that are included either on the C542 itself or on the DSKplus board can be used, they must be brought to the proper configuration state. For example, the input ports, the filter parameters of the board's analog interface circuit (CODEC), the analog-to-digital and digital-to-analog conversion rates are configured, and an interrupt vector table is loaded A system under test (SUT), in this case a free space listening environment, is excited with an MLS using a loudspeaker, and a received signal is taken as the sampled output of a microphone located in the same space. The impulse response of the path between the two can be deconvolved by cross-correlating the stimulus MLS with the received the signal. This is done, as described above with reference to the exemplary MLS of FIG. 5, by shifting the content of a serial port transmit register (TDXR) into the CODEC and then shifting data from the A/D converter into the serial port receive register (TRCV) and periodically convolve these data to establish the correct time scale of the received signal.

An actual auto-calibration of an exemplary N-channel surround sound system is performed using four Klipsch Pro-Media v.2–400 speakers. The subwoofer and center speaker, which are typically also part of a surround sound system, are not calibrated. Each of the speakers is calibrated separately and the corresponding coefficients are placed in a respective DSP memory. For performing the listening test, the matched filters can be turned on and off.

Figure 12A:
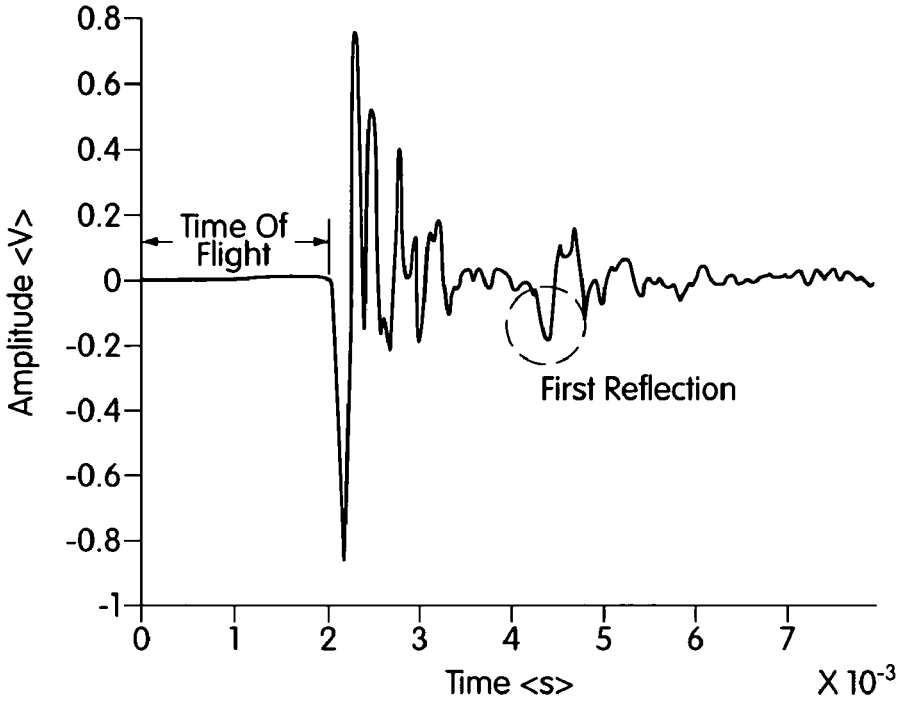
FIGS. 12*a–b* show a satellite loudspeaker impulse response (a) and an overlay of corresponding frequency responses in an open environment (b)
Figure 12B:
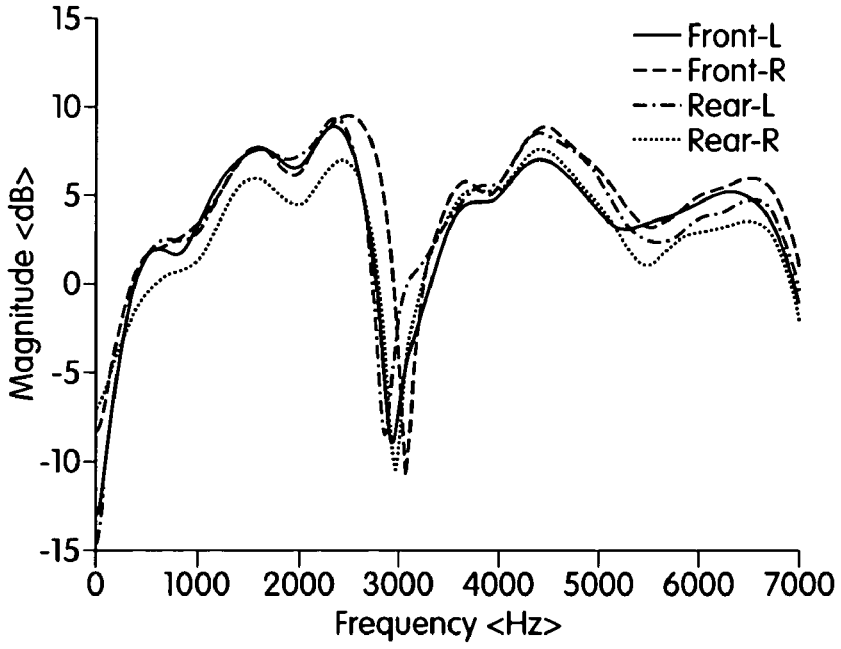
Figure 13A:
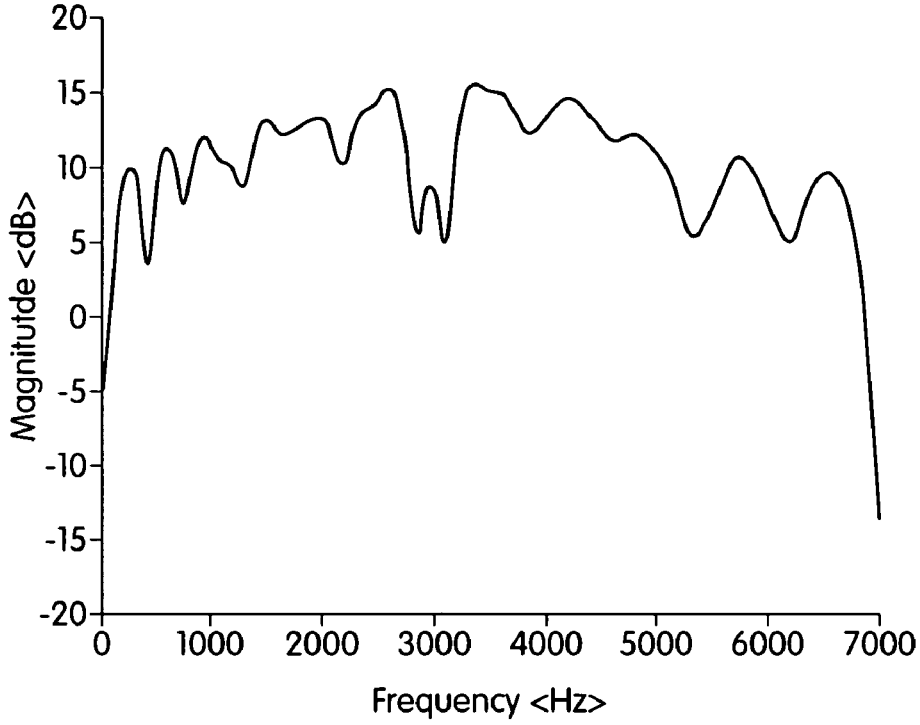
FIG. 13 shows the frequency response of four satellite loudspeakers (a)–(d) in a listening environment.
Figure 13B:
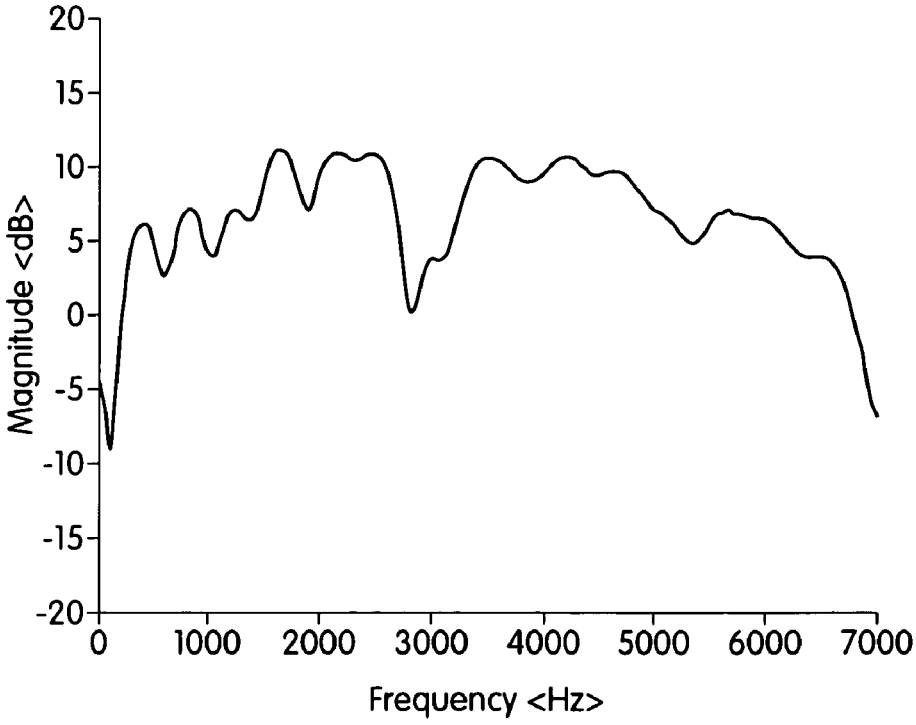
Figure 13C:
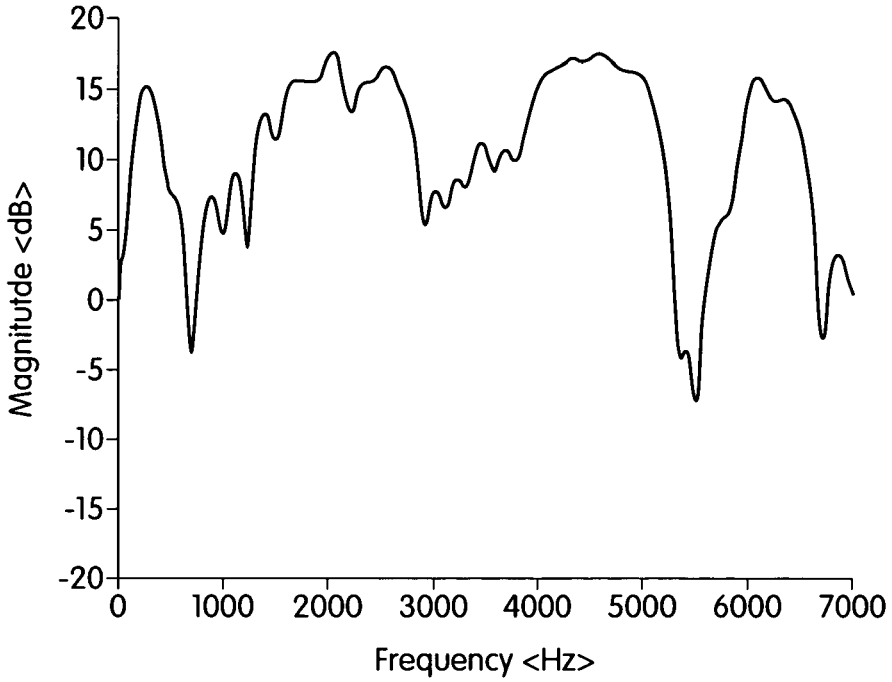
Figure 13D:
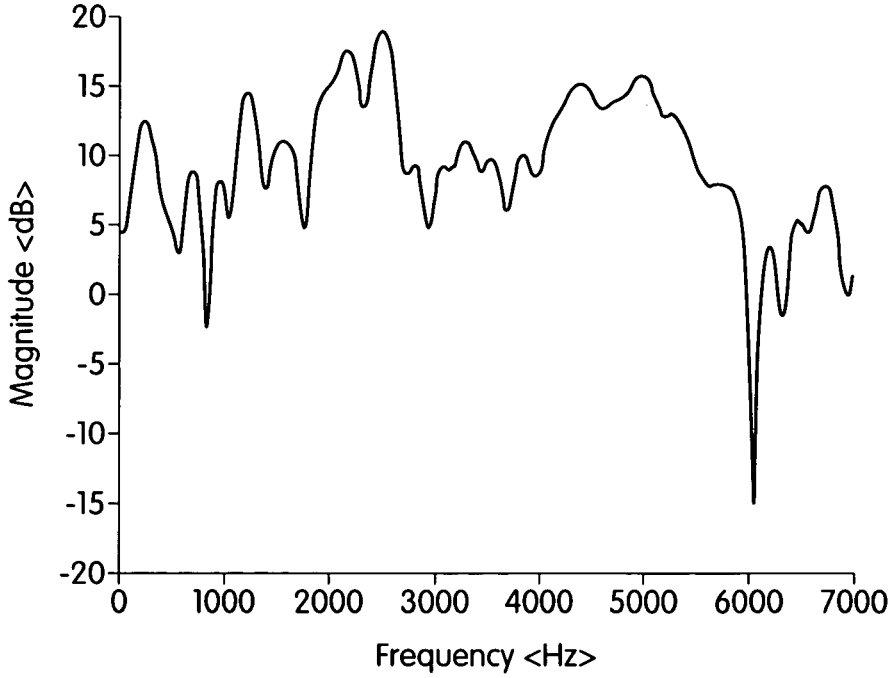

Referring now to FIGS. 12(*a*) and 12(*b*), before running the four-channel surround sound test, the impulse response for each of the satellite speakers in an open laboratory space is deconvolved using the MLS technique. The system is set up so that the four frequency responses can be compared. However, these measurements are not directly compared to those that are taken in the listening environment, since the microphone placement, sound pressure level at the microphone, and the surrounding acoustic impedances can all be different. Because all four responses are similar, they are plotted in an overlay fashion. FIG. 12(*a*) shows the impulse response of an exemplary satellite speaker (in this case, the front-right speaker in the listening environment), as well as the four overlaid frequency response magnitudes. The time of flight delay of approximately 2.2 ms indicates that the distance between the microphone and the speaker in this test was approximately 70 cm. Verifying distances like speaker placement using the exponentially determined time of flight (TOF) is a good way to determine if the periodic cross-correlation is extracting the correct time base. The response feature arriving with a delay of approximately 4.3 ms indicates a first reflected signal. The sharp drop in frequency response at about 3 kHz will be the most difficult portion of the spectral response to whiten. Only a selective region of the impulse response is modeled. Selecting the region after the TOF and before the first reflection will isolate the portion of the response known as the anechoic response which the direct path between the monitor and microphone. A minimum phase system has most of its energy around the beginning of the impulse response; therefore a system that includes more reflections in the region of interest becomes less minimum phase and has a greater error term. A minimum phase system is desirable to a create a stable inverse filter.

With the open space frequency response of each satellite speaker determined, the surround sound calibration in the actual listening environment is performed. Each of satellite speakers is calibrated individually, since even though they all have similar responses in the open space, the different placement of each speaker in the listening environment can cause the acoustic impedance to be different. FIGS. 13(*a*)–(*d*) show the responses from the four loudspeakers. It should be noted that the respective pairs front-left/rear-left loudspeakers (FIGS. 13(*a*) and 13(*c*)) and the front-right/rear-right loudspeakers (FIGS. 13(*b*) and 13(*d*)) have a similar response, which is due to the fact that the left satellites have a rigid wall on one side, which is essentially an infinite baffle, whereas the right satellites have no wall directly adjacent, providing a more absorbent surrounding.

Figure 14A:
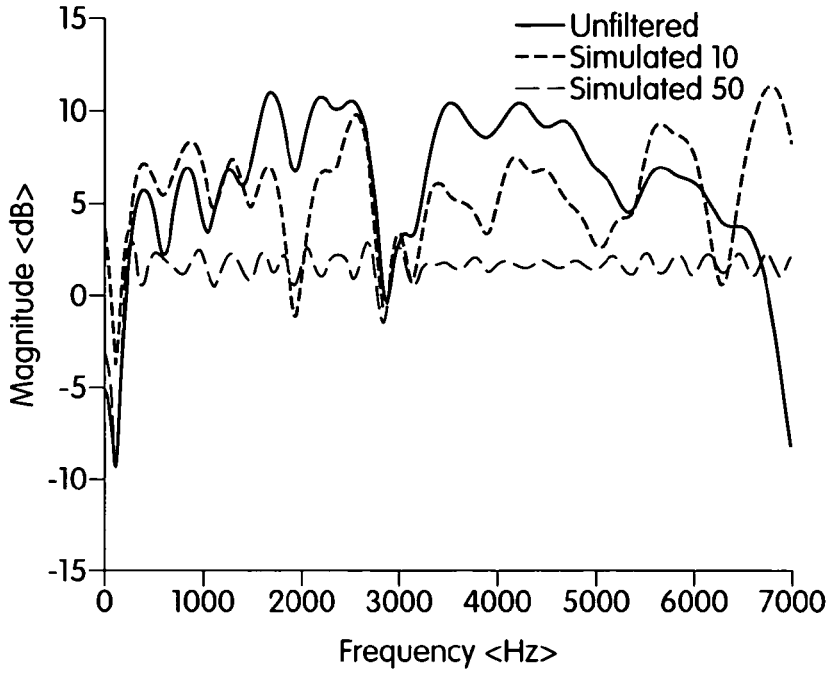
FIGS. 14*a–b* show an overlay of the original frequency response of the front-right loudspeaker (FIG. 13(*b*)) and simulated white frequency responses for filter order M=10 and M=50 (a) and the corresponding LMS error curve (b).
Figure 14B:
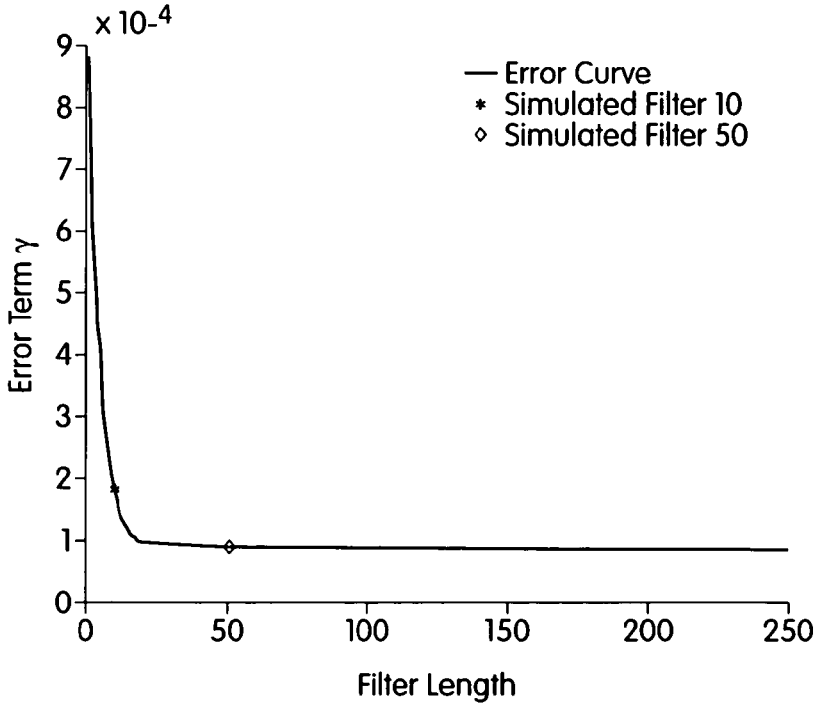

Referring now to FIG. 14, the original frequency response of the front left satellite speaker was whitened using the process and system of the invention described above to illustrate that the process is capable of performing in a real listening environment. FIG. 14(*a*) is an overlay of the unfiltered frequency response of the front-right loudspeaker (FIG. 13(*b*)) and simulated whitened responses computed for filter orders M=5 and M=50. FIG. 14(*b*) shows the LMS error curve with the marked simulated orders.

The overlay of FIG. 14(*a*) shows the closeness of the simulated and the actual whitened results, in particular for the filter order M=5. This observation combined with test chamber experiments demonstrate that identifying the system through correlation techniques, creating a matched filter of the "Moving Average" (MA) type, and performing real-time whitening may be implemented in practice.

While the process for automatic calibration of a surround sound system has been disclosed in connection with the preferred embodiments shown and described in detail, various modifications and improvements thereon will become readily apparent to those skilled in the art. For example, it may be desirable to differentiate between the actual impulse response information and the system noise, since it is of no interest to try and model any portion of the impulse response that is buried in the noise floor of the system. Accordingly, the results may be improved by comparing the energy, rather than the amplitude of the information carrying data which could result in an increase of the signal-to-noise ratio.

Reflections of the sound produced by a loudspeaker may also be of interest. The greater the time of flight (i.e., delay), the more phase compensation must be introduced by the matched filter. The more severe the reflections included in the analysis, the less the system becomes the minimum phase. Minimizing the summed square error terms (LMS) to generate the coefficients for the matched filter also works best for minimum phase systems. However, with LMS, the error performance deteriorates if the system becomes non-minimum phase. Systems that employ, for example, two compensation filters could be used for whitening mixed phase systems.

Because the human ear does not have a flat frequency response, a listening environment with a flat response is not necessarily the best choice. For example, an additional equalization could be added to obtain a desired preprogrammed frequency response curve. In addition, since the time of flight from each loudspeaker can be determined from the measured impulse response, one skilled in the art would recognize that corrective filter 32 could include the ability to adjust the relative delays of the audio signals.

It could also be envisioned to embed the auto calibration process of surround sound systems directly into so-called digital smart speakers (DSS) with a DSP and other supporting components implemented within the loudspeaker enclosure. Signals to these DSS loudspeakers could be analog or digital (or a combination of both analog and/or digital) and could convey audio information as well as loudspeaker identification information and electrical power. The user would simply connect any output of a receiver to any speaker, letting the processors decode the information which is intended for that specific location. Since transfer rates of modern networks are at least in the MHz range, technologies within the current art are fully adequate to support this level of functionality.

Accordingly, the spirit and scope of the present invention is to be limited only by the following claims.

What is claimed is:

1. A method of auto-calibrating a surround sound system, comprising the acts of:

producing an electric calibration signal, said calibration signal being a temporal maximum length sequence (MLS) signal, supplying said calibration signal to an electro-acoustic converter for converting the calibration signal to an acoustic response, transmitting the acoustic response as a sound wave in a listening environment to an acousto-electric converter for converting the acoustic response received by the acousto-electric converter to an electric response signal, correlating the electric response signal with the MLS signal to determine an impulse response, determining from the impulse response an anechoic portion of the impulse response between a time of flight signal and a first reflected signal, using the anechoic portion of the impulse response to compute filter coefficients, and processing the filter coefficients together with a predetermined channel response of the electro-acoustic converter to produce a substantially whitened system response.

2. The method of claim 1, wherein the acoustic response is radiated in the listening environment for a time less than approximately 3 seconds.

3. The method of claim 1, wherein the surround sound system includes a plurality of audio channels, with each channel having at least one electro-acoustic converter, wherein the substantially whitened response is produced independently for each audio channel.

4. A method of optimizing a matched filter for whitening an audio channel in a listening environment, comprising:

a. producing in the audio channel a test output sound corresponding to a temporal maximum length sequence (MLS) signal, b. receiving the test output sound at a predetermined location in the listening environment and correlating the received signal with the MLS signal to produce an impulse response, c. generating filter coefficients of the matched filter, d. repeating steps (a) through (c) with at least one other MLS signal having a different temporal maximum length, and e. optimizing the matched filter by selecting those generated filter coefficients that minimize an error term between a desired filter response of the matched filter producing the whitened audio channel and the filter response produced with the generated filter coefficients when driven by the corresponding maximum length MLS signal.

5. The method of claim 4, wherein the filter coefficients represent coefficients of a polynomial model of the impulse response.

6. The method of claim 5, wherein generating the filter coefficients includes optimizing a closeness of fit between the polynomial model and the matched filter.

7. The method of claim 5, further comprising cascading the matched filter with a useful audio signal so as to produce the substantially whitened audio channel.

8. The method of claim 4, wherein the filter coefficients are generated by an auto regressive (AR) model.

9. The method of claim 4, further comprising before step (c): analyzing the impulse response and determining an anechoic portion of the impulse response located between a time of flight signal and a first reflected signal, and generating the filter coefficients of the matched filter from the anechoic portion.

10. An auto-calibrating surround sound (ACSS) system, comprising:

an electro-acoustic converter disposed in an audio channel and adapted to emit a sound signal in response to an electric input signal, a processor generating a test signal represented by a temporal maximum length sequence (MLS) and supplying the test signal as the electric input signal to the electro-acoustic converter, and an acousto-electric converter receiving the sound signal in a listening environment and supplying a received electric signal to the processor, wherein the processor correlates the received electric signal with the MLS sequence to compute an impulse response, determines from the impulse response a time of flight signal and a first reflected signal, thereby defining an anechoic portion of the impulse response, computes filter coefficients from the anechoic portion of the impulse response, and processes the filter coefficients together with a predetermined channel response of the electro-acoustic converter to produce a substantially whitened system response.

11. The ACSS system of claim 10, wherein the processor includes an impulse modeler that produces a polynomial least-mean-square (LMS) error fit between a desired whitened response and the substantially whitened response determined from the correlated signals.

12. The ACSS system of claim 10, further comprising a coefficient extractor which generates filter coefficients of a corrective filter to produce the substantially whitened response of the audio channel.

13. The ACSS system of claim 12, wherein the corrective filter is located in anaudio signal path between an audio signal line input and the electro-acoustic converter and cascaded with the audio signal line input.

14. The ACSS system of claim 12, wherein the corrective filter forms a part of the processor.

15. The ACSS system of claim 10, wherein the processor is a digital signal processor (DSP).

16. The ACSS system of claim 15, further including an analog-to-digital (A/D) converter that converts an analog audio line input and the electric signal supplied by the acousto-electric converter into temporal digital signals.

17. The ACSS system of claim 15, further including a digital-to-analog (D/A) converter that converts digital output signals from the DSP to an analog audio line output for driving the electro-acoustic converter.

* * * * *